US006361234B1

(12) United States Patent
Rukan et al.

(10) Patent No.: US 6,361,234 B1
(45) Date of Patent: Mar. 26, 2002

(54) PRESSURIZED WRITING INSTRUMENT EMPLOYING A COMPRESSIBLE PISTON MEMBER

(75) Inventors: Ronald S Rukan, Simpsonville, SC (US); Albert D'Addario, Southington, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 09/520,095

(22) Filed: Mar. 8, 2000

(51) Int. Cl.[7] ..... B43K 5/06
(52) U.S. Cl. ..... 401/180; 401/190
(58) Field of Search ..... 401/190, 187, 401/188 A, 171, 176, 180, 135

(56) References Cited

U.S. PATENT DOCUMENTS

| | | | | |
|---|---|---|---|---|
| 68,727 | A | 9/1867 | Gabriel | |
| 229,102 | A | 6/1880 | Dellenbaugh | |
| 659,925 | A | 10/1900 | Hooker | |
| 1,030,502 | A | 6/1912 | Carter | |
| 1,409,613 | A | 3/1922 | Strasser | |
| 1,447,495 | A | 3/1923 | Stromborg | |
| 2,192,479 | A | 3/1940 | Nissen, Jr. | 91/67.4 |
| 2,249,163 | A | 7/1941 | Nissen, Jr. | 91/62.6 |
| 2,391,385 | A | 12/1945 | Boral | 120/47 |
| 2,426,453 | A | 8/1947 | Huenergardt | 120/43 |
| 2,427,069 | A | 9/1947 | Randolph | 120/49 |
| 2,438,786 | A | 3/1948 | Moore | 120/42 |
| 2,551,490 | A | 5/1951 | Ferst et al. | 120/42.4 |
| 2,557,409 | A | 6/1951 | Brinson | 120/42.4 |
| 2,606,529 | A | 8/1952 | Wagner | 120/42.4 |
| 2,777,422 | A | 1/1957 | Cofield, Jr. et al. | 120/42.4 |
| 3,008,476 | A * | 11/1961 | Pepin | 401/180 |
| 3,124,107 | A | 3/1964 | Fehling et al. | 120/42.4 |
| 3,130,711 | A | 4/1964 | Eckerle | 120/42.4 |
| 3,181,539 | A | 5/1965 | Aston | 132/79 |
| 3,234,917 | A | 2/1966 | Fehling et al. | 120/42.4 |
| 3,282,255 | A | 11/1966 | Killen | 120/42.4 |
| 3,334,616 | A | 8/1967 | Urquhart | 120/42.4 |
| 3,340,560 | A | 9/1967 | Nakata | 15/563 |
| 3,397,939 | A | 8/1968 | Berry | 401/198 |
| 3,775,015 | A | 11/1973 | Tsunoda et al. | 401/190 |
| 4,937,594 | A | 6/1990 | Niemeyer | 346/140 |
| 4,973,180 | A | 11/1990 | Hori | 401/141 |
| 5,249,875 | A | 10/1993 | Hori et al. | 401/148 |
| 5,628,576 | A * | 5/1997 | Smith | 401/190 |

* cited by examiner

*Primary Examiner*—Gregory L. Huson
*Assistant Examiner*—Tuan Nguyen
(74) *Attorney, Agent, or Firm*—Penniie & Edmonds LLP

(57) ABSTRACT

A pressurized writing device comprising an ink tube having a first end and second end, a writing tip at the first end, an end plug at the second end, a pressurizing system. The pressurizing system applies a force to a writing medium in the ink tube to force the writing medium out the writing tip pressurization system includes, a compressible ink driving member. The compressibility of the ink driving member assures a secure seal of the writing medium in the ink tube. Additionally, the compressibility permits the ink driving member to wipe ink off the interior surface of the ink tube as ink is expended. Ink residue in the ink tube is thus minimized. In a preferred embodiment, the ink driving member is spherical to facilitate manufacture of the ink driving member and assembly of the writing instrument. The spherical shape also enhances the sealing and wiping effects of the compressible ink driving member.

26 Claims, 2 Drawing Sheets

PRESSURIZED WRITING INSTRUMENT EMPLOYING A COMPRESSIBLE PISTON MEMBER

FIELD OF THE INVENTION

The present invention relates generally to pressurized writing devices and more specifically to pressurized writing devices employing a compressible ink driving member.

BACKGROUND OF THE INVENTION

Pressurized writing instruments are common to the writing instrument industry and have been in use for many years. Pressurized systems have been used to minimize solvent loss in writing instruments which employ highly volatile solvents and in applications which employ high viscosity inks wherein pressure is needed to force the flow of ink to the writing tip. Moreover, the use of pressurized devices in writing instruments permits the writing instrument to be used for extended periods of time in horizontal and upside-down orientations, and has reduced the need to vigorously shake the instrument to initiate ink flow after storage in an inverted position.

Mechanical and chemical pressurizing devices are two types of pressurizing systems which have been employed in writing instruments. Mechanical pressurizing devices contain a mechanism, such as a spring, to maintain constant pressure on the writing medium as the writing medium is consumed. Gas-pressurized systems typically use a pressurized gas, such as nitrogen, to feed ink to the point or nib of the writing instrument. Some of these devices produce a pressurized gas, such as nitrogen, through chemical reactions, fermentation, and the like. The gas maintains pressure on the writing medium for continuous supply of the medium to the point or nib of the writing instrument. U.S. Pat. No. 3,130,711 to Eckerle describes writing instruments employing pressurized gas systems. Examples of commercially available writing instruments which employ pressurized gas systems include the Papermate Erasermate2™, produced by The Gillette Company (USA), of Boston, Mass., and the Fisher Space Pen®, produced by the Fisher Space Pen Company of Boulder City, Nev.

The loss of gas through leakage or permeation is a major concern in pressurized gas systems. Thus, maintenance of an airtight seal and the prevention of gas leakage from the seal are important factors in designing gas-pressurization systems. Often, the gas retention properties of the writing instrument are the limiting factor determining the usable shelf life of the product. Maintenance of an airtight seal is difficult to accomplish in gas-pressurized systems for various reasons. Certain gas systems do not permit the use of certain bonding techniques due to the potential interaction or exposure of the bonding material or solvent with the pressurizing gas. In an effort to provide more effective sealing, liquid sealants have been used in conjunction with plug members to maintain the integrity of the gas seal. However, this combination often produces internal pressure variations which interfere with the uniform flow of the writing medium. The liquid sealant may also be chemically incompatible with at least one of the materials of the writing instrument, causing those materials to interact.

An additional design consideration with respect to gas-pressurization systems is the interaction of the component containing the gas pressurization system (hereinafter the "ink tube" for the sake of simplicity) with the writing medium as well as the stability of the ink tube. If a volatile writing medium is used, the ink tube must be made of a material that is not gas permeable moreover, the ink tube must be able to withstand stresses during use, such as imparted by the pressurization system. Any crack in such component will allow the gas to escape, eliminating the pressure required to feed the ink to the writing tip and thus rendering the writing instrument unusable. For this reason, nylon is often used. However, nylon is more expensive than some alternative materials. Moreover, since Nylon is relatively weak, a nylon ink tube must have thick walls to withstand stresses occurring during normal use. The formation of a nylon tube with sufficiently thick walls increases material costs of an already relatively expensive ink tube. Nylon also has shrinkage and creep properties inferior to alternative materials, resulting in relatively less dimensional stability. Furthermore, nylon is somewhat hygroscopic, and generally must be dried before being molded to form the ink tube to avoid dimensional instabilities which may result from water absorption.

Another design consideration with respect to gas-pressurized systems is the shape and dimension of the ink tube. In particular, the ink tube must have a relatively small cross-sectional area to ensure that the meniscus formed at the top of the ink supply prevents the pressurizing gas from flowing to the writing end of the writing instrument in the event the writing instrument is placed on its side, or turned upside-down. Transfer of the pressurizing gas to the writing end of the writing instrument raises the possibility of a gas pressure leak. Particularly, such transfer may result in the creation of trapped pressurized gas bubbles within the ink supply when the writing instrument is placed in position for use. If such bubbles reach the writing ball, the gas will escape. Once insufficient gas remains in the writing instrument to force the ink to the writing tip, the writing instrument will be rendered unusable.

A mechanical pressurization system has several advantages over a gas pressurized system. These advantages include simplification of the assembly process, greater control and regularity of the ink pressure, no risk of loss of pressurizing gas to the atmosphere, and no risk of interaction of the pressurizing gas with the components of the writing instrument. However, prior attempts to create a mechanically pressurized writing instrument have also encountered disadvantages, such as: operation being reasonable only in the vertical position (such as in U.S. Pat. No. 4,937,594 to Niemeyer), uneven force being applied to the ink column as the ink supply is exhausted, and added expense and complexity due to the precision required in producing an ink driving member which will fit tightly enough within the ink tube to prevent leakage past the ink driving member yet will still slide freely within the ink tube. Usually, the addition of a lubricant is required to prevent any leakage past the piston and to facilitate movement. U.S. Pat. No. 3,282,255 to Killen uses a mechanical manual "pump" to pressurize the ink in the reservoir but cannot provide a consistent force on the ink reservoir.

Manufacturing considerations with respect to the ink tube may also complicate design of a pressurization system which functions as desired. For instance, to facilitate manufacturing, an injection molded ink tube typically is tapered towards the writing tip to facilitate separation from the mold pin therein upon completion of the molding process. The unyielding, incompressible piston members of prior art pressurization systems cannot maintain a seal at the wider section of the ink tube yet also fit in the narrowest section to expel all ink from the writing instrument.

There remains a need to provide an improved pressurized writing instrument in which the internal pressure is maintained throughout the entire life of the writing device, without overly complex or expensive seals, to allow for smooth and continuous flow of ink, even where the diameter or dimensions of the ink tube vary, and regardless of the orientation of the writing device.

SUMMARY OF THE INVENTION

In accordance with the principles of the present invention, a writing instrument employing a pressurizing system to feed ink to a writing tip is provided with a compressible ink driving member. The compressible ink driving member is capable of deforming to conform to the contours of the walls of the ink tube. The compressible ink driving member preferably acts as a fluid seal to prevent the writing medium from flowing past the ink driving member. Moreover, the deformed ink driving member facilitates wiping of the writing medium from the ink tube walls.

The compressibility of the piston member also has advantages in the manufacture and assembly process of the writing instrument by eliminating the need to manufacture precision parts with tight tolerances. Any minor variations in the size of the piston member or the ink reservoir is compensated for by the ability of the piston member to deform.

BRIEF DESCRIPTION OF THE DRAWING

Features of the present invention are disclosed in the accompanying drawing. The invention, together with further objects and advantages thereof, may best be understood by reference to the following description taken in conjunction with the accompanying drawing wherein.

DESCRIPTION OF THE PREFERRED EMBODIMENT

Figure 1:
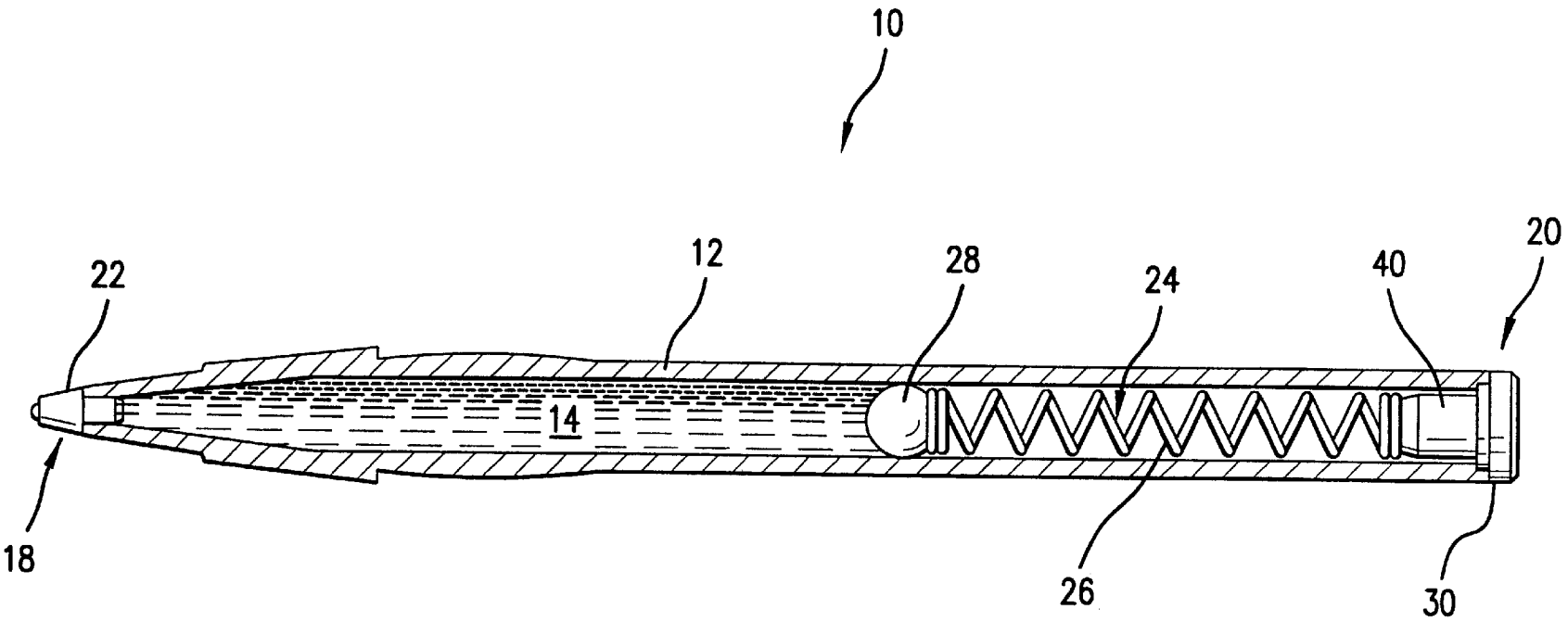
FIG. 1 is a cross-sectional view along the longitudinal axis of a writing device constructed in accordance with the principles of the present invention.

Turning to FIG. 1, an embodiment of a writing device 10 constructed in accordance with the present invention is shown with the understanding that those of ordinary skill in the art will recognize many modifications and substitutions which may be made to various elements. Writing device 10 may be used independently as a writing instrument or may be formed as a cartridge for insertion into a barrel or writing implement housing.

Writing instrument 10 generally includes an ink tube 12 partially filled with a writing medium 14 (alternately referenced herein as "ink" for the sake of convenience without intent to limit the writing medium to only ink). Ink tube 12 has a first end 18 and a second end 20. At the first end 18 of the ink tube 12, a writing tip 22 is provided. Writing tip 22 may be a typical ball-type writing point with a ball installed in a socket. However, any other form of writing tip may be used instead.

One embodiment of writing instrument 10 is designed for a highly viscous ink. Advantageously, writing medium 14 is thixotropic. For example, in the case of a ball point pen, when the writing tip 22 contacts a writing surface, the tip of a ball point pen will roll, "stirring" the thixotropic writing medium near the ball and lowering its viscosity. The less viscous writing medium near the ball will then flow more freely from the tip of the pen onto the writing surface. However, the writing medium 14 may, instead, have a low viscosity, as discussed herein.

Figure 2:
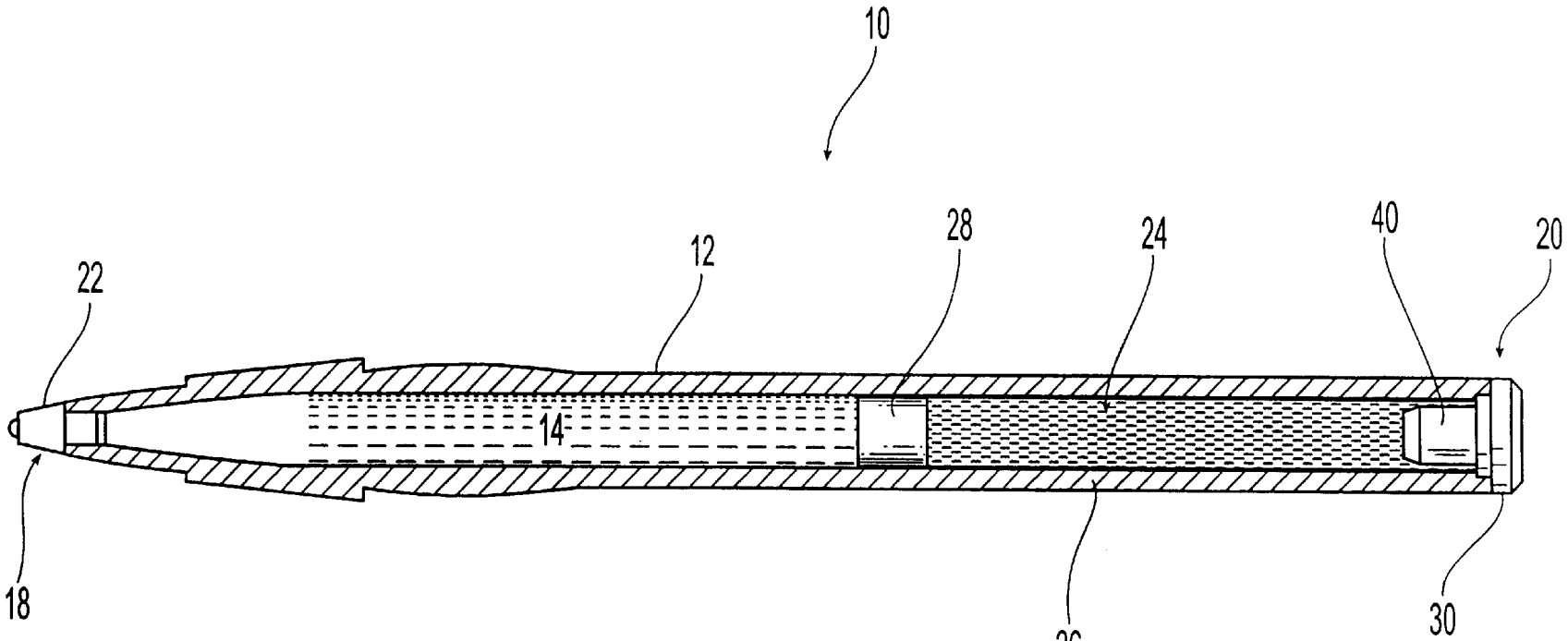
FIG. 2 is a cross-sectional view similar to FIG. 1 showing a different ink driving member and a different pressurizing system.

A pressurization system 24 is provided in ink tube 12 of writing instrument 10 to pressurize writing medium 14. By pressurizing a highly viscous writing medium 14, pressurization system 24 assists in feeding the writing medium 14 out of writing tip 22. The pressurization system 24 preferably comprises a pressurization device 26 and an ink driving member 28. In the embodiment shown in FIG. 1, writing instrument 10 includes a mechanical pressurization system 24, although any other pressurization system, such as a gas system (such as shown in FIG. 2), may be used instead. Pressurization system 24 of FIG. 1 generally includes an ink driving member 28 driven by a pressurizing device 26, such as a spring, installed in the ink tube 12 of writing instrument 10. Pressurizing device 26 applies force to ink driving member 28, which, in turn, pressurizes writing medium 14. Preferably, pressurizing device 26 is designed to mimic the pressure changes which occur in gas-pressurization systems. Alternatively, pressurizing device 26 may be designed to maintain a relatively constant force upon ink driving member 28. In any event pressurization system 24 must apply force to writing medium 14, at a rate sufficient to keep up with the next drastic utilization of writing medium.

Pressurization system 24 must provide sufficient force upon writing medium 14 throughout the life of writing instrument 10 to expel all of the writing medium 14 within ink tube 12 out of the writing tip 22. The maximum initial pressure exerted by pressurizing device 26 is selected such that ink is not driven out of writing tip 22 unintentionally. Moreover, the force of pressurization system 24 and the rheology of the writing medium must be selected such that the driving member pushes the writing medium without being pushed into the writing medium. For example, the initial force exerted by pressurizing device 26, when ink tube 12 is full of writing medium 14, may be between 80–90 psi and preferably at least about 80 psi. When the writing medium 14 is nearly expended, pressurizing device 26 preferably exerts a final pressure sufficient to provide a minimum force necessary to push driving member 28 to its furthest possible position within ink tube 12 to expel ink. For example, the final pressure exerted by pressurizing device 26 is preferably about 15–20 psi and at least about 10 psi. If pressurizing device 26 is a spring, then the spring constant and spring rate are selected to achieve the above functions.

Pressurization system 24 must be securely retained within writing instrument 10. One way of securely retaining pressurization system 24 is to provide a barrier at the back end 20 of ink tube 12 of the writing instrument to prevent pressurization system 24 from escaping from writing instrument 10. Again, referring to the embodiment of FIG. 1, an end plug 30 is preferably coupled to second end 20 of ink tube 12. End plug 30 closes end 20 of ink tube 12 in order to retain the pressurization system 24 within writing instrument 10. Additionally, end plug 30 may be shaped and configured to serve as a base and support for pressurization system 24. End plug 30 preferably is also shaped and configured to stabilize pressurization system 24. For example, if pressurizing device 26 is a spring, end plug 30 may be provided with a stem 40 that is shaped and configured for insertion into or affixation to pressurizing device 26. If desired, stem 40 is chamfered to facilitate insertion into the interior of the spring. End plug 30 must also be securely attached to ink tube 12 to prevent the pressurizing device 26 from forcing end plug 30 off second end 20 of ink tube 12. For example, end plug 30 may be welded (e.g., by utilizing ultrasonic welding) or bonded (e.g., by solvent bonding) to second end 20 of ink tube 12. A double seal, as described in U.S. Pat. No. 5,924,810 to Rukan et al., which patent is incorporated herein by reference in its entirety, may be used.

Depending upon the type of writing medium used, the writing instrument may need to be either vented or sealed. In the preferred embodiment of FIG. 1, end plug 30 may be provided with a vent to prevent the creation of a vacuum in the rear of the ink tube as the writing medium is expended, thereby inhibiting the entry of air bubbles into the writing medium reservoir, which may cause "starving" of writing medium to writing tip 22. However, if a volatile writing medium is used, the writing instrument must be adequately sealed so that there is no ventilation, in order to prevent evaporation of the writing medium.

In order to facilitate sealing, as well as to provide other advantages, ink driving member 28 is preferably compressible. Compressibility of ink driving member 28 allows deformation of ink driving member 28 when placed inside ink tube 12. This deformation compensates for any dimensional variations between ink driving member 28 and the contours of the interior of ink tube 12. The ability of a compressible ink driving member 28 to conform to the shape and dimensions of ink tube 12 also obviates the need to manufacture precision parts with tight tolerances for a close fit between ink driving member 28 and the interior of ink tube 12.

It is noted that the use of a pressurizing device 28 assists in deforming ink driving member 28 as desired. Moreover, deformation of ink driving member 28 also increases the contact surface area of the portion of ink driving member 28 against the inner surface of ink tube 12. As may be appreciated, the close fit or contact between ink tube 12 and driving member 28 facilitate complete sealing of writing medium 14 within ink tube 12. Such sealing may be sufficiently tight to eliminate the need for a sealing lubricant which often has deleterious effects on the system, such as plastication of the materials thereof. The seal acts as a barrier to solvent vapor migration, as well as additional benefits. For instance, complete sealing of ink tube 12 by a compressible ink driving member 28 allows writing instrument 10 with a low viscosity to be employed in a sideways or even upside-down position, since the seal prevents backflow of writing medium 14 behind ink driving member 28. Moreover, the close fit or contact between ink tube 10 and a compressible ink driving member 28 allows ink driving member 28 to wipe ink from the inner surface of ink tube 12 as writing medium 14 is expended and ink driving member 28 progresses towards writing tip 22. Thus, loss of ink past driving member 28 (residual ink along the interior of ink tube 12) as the ink driving member 28 proceeds to writing tip 22 is minimized.

Compressibility also permits use of an ink driving member 28 with an outside diameter (when ink driving member 28 is not being compressed) greater than the inside diameter of ink tube 12. A compressible ink driving member 28 preferably has an outside diameter or dimension greater than the inside diameter or dimension of ink tube 12 and substantially conforms to the interior contours of ink tube 12 such that ink driving member 28 deforms upon insertion into ink tube 12, resulting in the advantages listed above. It will be appreciated that compressibility of ink driving member 28 also permits, ready used within an ink tube 12 of varying diameter or dimension. Thus, a compressible ink driving member 28 is advantageously used is an ink tube 12 which tapers toward the writing end of writing instrument 10. Thus, ink driving member 28 can be large enough to fit into and contact the inner surface 32 of ink tube 12 at the widest portion of the ink tube, yet deform to fit into even the narrowest portion.

The hardness, such as determined under the Shore A durometer scale (or any other scale), of ink driving member 28 is selected so that ink driving member 28 is relatively soft and pliable to permit the above-described desired compressibility along with the accompanying benefits of such compressibility. The hardness should be selected so that ink driving member 28 is not prevented from deforming to fit within the inside of ink tube 12. Also, a hardness of above about a Shore A durometer of 70 may create a large enough frictional force from its contact with the inner surface of ink tube 12 to inhibit advancement of the ink driving member 28 in ink tube 12 thus reducing the efficacy of pressurization system 28. In order to permit ink driving member 28 to be compressed and/or to deform, ink driving member 28 preferably has a hardness of less than 70. Preferably, the hardness of the ink driving member 28 is not so low as to have a "gummy" texture that will not be capable of sliding as necessary within ink tube 12. Also, a very soft ink driving member 28 will inhibit the ability of ink driving member 28 to tightly seal the writing medium, since ink driving member 28 will deform easily, exerting only a low compression force onto ink tube 12. Ink driving member 28 preferably has a Shore A durometer hardness of at least about 8.

Preferably, ink driving member 28 is also solid so that it deforms uniformly under force and does not unequally absorb forces imparted thereto. Moreover, a solid member typically exerts an evenly distributed load on ink tube 12, thus improving the desired sealing effect.

The material from which ink driving member 28 is formed also may affect the desired benefits to be imparted by ink driving member 28. For example, the material should be capable of sliding within ink tube 12 as necessary to drive the writing medium out, yet should sufficiently resist sliding movement such that the ink driving member deforms when subjected to force applied by pressurizing device 26. Thus, the material should allow ink driving member 28 to advance the ink while also forming an effective seal against the interior of ink tube 12 and effecting the above-described wiping of ink from the interior of ink tube 12. Preferably, the coefficient of friction between the driving member 28 and ink tube 12 is at least 0.15 and at most 0.45. Ideally this coefficient of friction between these elements is less than 0.25, and must preferably within a range of almost about 0.15 to 0.25. It will be appreciated that construction of the invention is simplified because ink driving member 28 slides freely within ink tube 12 yet also provides a tight seal therein, without the use of a sealing lubricant or the need to machine the ink driving member 28 to very tight tolerances as required with conventional, non-deformable pistons.

The material by ink driving member 28 preferably is also selected to be chemically compatible with the materials from which other components of writing instrument 10 are formed and with which ink driving member 28 may interact or contact. Thus, ink driving member 28 is preferably chemically compatible with at least ink tube 12 as well as with writing medium 14. In particular, the material of ink driving member 28 preferably is selected such that ink driving member 28 will not swell in solvents used in writing medium 14, and will not absorb solids used in writing medium 14. Such chemical compatibility will lend stability to ink driving member 28 since absorption of ink or ink components may change the material characteristics of the ink driving member 28, such as elasticity, elongation, tensile strength, yield strength, etc. Also, ink driving member 28 preferably is resistant to wetting, particularly by writing medium 14. Most preferably, ink driving member 28 is repellant to writing medium 14 to further enhance the above-described ink-wiping effected by ink driving member 28 to provide an additional force to prevent writing medium 14 from escaping past ink driving member 28. The ink driving member 28 preferably has a surface tension of less than about 20 dyne-cm to inhibit wetting by writing-medium 14. A writing- medium-repellant coating may also be applied to the surface of ink driving member 28 to enhance the anti-wetting property of ink driving member 28.

In order to achieve the above-described characteristics and material properties, ink driving member 28 preferably is formed from an elastomeric material which by nature is compressible. Most preferably, a synthetic elastomer, which affords more controllable characteristics than a natural elastomer, such as compressibility and ink resistance, is used. Examples of materials having some of the above-mentioned properties include, without limitation, silicone elastomers, neoprene elastomers, fluoroelastomers, fluorocarbon elastomers, polyolefin elastomers, urethane elastomers, and polyurethane elastomers. Most preferably, the ink driving member is formed from thermoplastic elastomer, such as Santoprene™. Santoprene™ is sold by Advanced Elastomer Systems, L.P., Akron, Ohio.

It will be appreciated that the material from which ink tube 12 is formed preferably is selected to be chemically compatible with the other materials of writing instrument 10. In particular, ink tube 12 preferably is formed from a material that is chemically compatible with writing medium 14. For instance, if a volatile writing medium is used, then the material of ink tube 12 should provide a solvent barrier for the solvents of the volatile ink. If a gas pressurization system is employed in writing device 10, the ink tube should also be gas impermeable. Moreover, the material of ink tube 12 should be sufficiently strong and durable for its intended use. For instance, the ink tube 12 should not fatigue, crack, or deform during use (e.g., should withstand internal pressures generated by pressurization system 24), and preferably is environmentally stable as well as dimensionally stable at all temperatures. Most preferably, to facilitate manufacturing (such as by injection molding), ink tube 12 is formed from a thermoplastic or thermoformable material. Nylon is typically used for gas pressurized systems since Nylon not only provides the desired solvent barrier but also is gas impermeable. However, if a mechanical pressurization system, such as described above, is employed, gas permeability is irrelevant and a wider variety of materials may be used. Ink tube 12 may thus be formed from an engineering plastic which has the appropriate strength, rigidity, resistance to deformation, and chemical resistance to writing mediums and solvents. Examples of suitable materials which may be used to form an ink tube 12 in which a mechanical pressurization system is to be used include, without limitation, polyacetal, polyolefin, polyester, polyketone, polyamide, polysulfone, polystryrene, ABS, acrylic, polycarbonate, polyurethane, polyamide, cellulosics, chloride (PVC), polyvinyledene chloride, fluoroplastics, and any copolymers or mixtures thereof. Some examples of preferred engineering plastics include Celcon®, produced by Ticona, of Summit, N.J., or Delrin®, produced by DuPont de Nemours of Wilmington, Del. It will be appreciated that the use of materials other than nylon typically reduces costs, since nylon is typically expensive and weak (requiring formation of an ink tube with relatively thick walls). Moreover, the above-listed materials typically have shrinkage and creep properties superior to nylon and are less hygroscopic, and thus impart greater dimensional stability to the ink tube. It is thus readily appreciated that use of a mechanical pressurization system advantageously effects the manufacture of the ink tube in which the system is to be contained.

The shape of ink driving member 28 preferably is selected to enhance the above-described advantages of the pressurization system 24 of the present invention. Advantageously, ink driving member 28 preferably is spherical. A spherical geometry facilitates assembly of writing instrument 10, since a spherical member is completely symmetrical and thus need not be oriented in a particular direction before insertion into ink tube 12. Also, the symmetrical shape ensures that the compression load exerted by ink driving member 28 will be uniformly distributed to an ink tube of typical cylindrical shape. Furthermore, the compressed surface of a spherical ink driving member has a larger contact surface than an uncompressed ink driving member, thus advantageously enhancing the above-described sealing and wiping effects. It will be appreciated that other shapes resulting in such benefits may be used. For instance, a cylindrically shaped ink driving member 28 (such as shown in FIG. 2) would also provide ease of assembly, since it applies a substantially uniform compression load on a cylindrically shaped ink tube 12, and no particular orientation, at least about its longitudinal axis, is required.

The writing instrument 10 is preferably manufactured by providing an ink tube 12 having a first end 18 and a second end 20. A writing tip 22 is preferably coupled to first end 18. Ink tube 12 then is filled with writing medium 14, and a pressurization system 24 including a preferably compressible ink driving member 28 driven by pressurizing device 26, is installed in ink tube 12 thereafter.

Manufacturing of ink driving member 28 may also be tailored to further enhance its ability to seal ink tube 12. In particular, ink driving member 28 preferably is formed to have a smooth surface finish for enhanced contact and sealing with ink tube 12. Preferably, ink driving member 28 is formed by a compression molding process, and ground to its final shape to remove dimensional surface imperfections.

It will be appreciated that a compressible ink driving member may also be used in a gas-pressurization system in accordance with the principles of the present invention, such benefits provided in a mechanical pressurization system by such an ink driving member being similarly provided to a gas-pressurization system utilizing such an ink driving member.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A pressurized writing instrument comprising:

an ink tube at least partially filled with a writing medium, said ink tube having an inner surface a first end, and a second end, said inner surface being tapered from said second end towards said first end;

a writing tip at said first end of said ink tube; and a pressurization system comprising a compressible spherical ink driving member having a diameter large enough to fit deformably into and to contact said tapered inner surface of said ink tube such that said ink driving instrument exerts a compression load on said tapered inner surface uniformly from said second end to said first end.

2. The writing instrument as in claim 1, wherein said ink driving member is formed from an elastomer.

3. The writing instrument as in claim 1, wherein said ink driving member is ink-repellant.

4. The writing instrument as in claim 1, wherein said pressurizing system further comprises a mechanical pressurizing device retained between said second end and said ink driving member, said mechanical pressurizing device applying pressure to said ink driving member and said writing medium.

5. The writing instrument as in claim 4, wherein said mechanical pressurizing device is a spring.

6. The writing instrument as in claim 4, wherein said spring mimics pressure changes occurring in gas-pressurization systems.

7. The writing instrument as in claim 4, wherein said spring applies a constant pressure to said ink driving member.

8. The writing instrument as in claim 1, wherein an end plug is provided at said second end to retain said pressurization system within said pressurized writing instrument.

9. The writing instrument as in claim 1, wherein said ink tube is formed from an engineering plastic.

10. The writing instrument as in claim 9, wherein said ink tube is formed from polyacetyl.

11. The writing instrument as in claim 1, wherein said ink driving member is solid.

12. The writing instrument as in claim 1, wherein said pressurizing system comprises a gas pressurization system.

13. The writing instrument as in claim 1, wherein the exterior surface of said ink driving member is ground to a smooth finish.

14. A method of manufacturing a writing instrument comprising:

providing an ink tube having a first end, a second end, and a writing tip coupled to said first end, said tube having an inner surface tapering from said second end to said first end;

filling said ink tube with ink;

orienting a compressible ink driving member having a diameter large enough to fit deformably into and to contact said tapered inner surface of said ink tube at most along a single axis without regard to ends of said ink driving member; and inserting said compressible ink driving member; and a pressurizing device into said second end of said ink tube such that said pressurizing device moves said ink driving member toward said first end of said ink tube and causes said ink driving member to contact and to exert a uniform compression load on said tapered inner surface of said ink tube.

15. The method of claim 14, wherein said ink driving member is formed by a compression molding process.

16. The method of claim 15, wherein the exterior surface of said ink driving member is ground to a smooth finish.

17. The method of claim 14, wherein said compressible ink driving member is spherical and need not be oriented before being inserted into said ink tube.

18. A pressurized writing instrument comprising:

an ink tube having a tapered inner surface at least partially filled with a writing medium, said ink tube having a first end and a second end;

a writing tip at said first end of said ink tube; and a pressurization system comprising a compressible solid ink driving member having a diameter large enough to fit deformably into and to contact said tapered inner surface of said ink tube such that said ink driving member deforms uniformly under force to conform to the shape and dimensions of said tapered inner surface of said ink tube, thereby compensating for dimensional variations between said ink driving member and said tapered inner surface of said ink tube, and does not unequally absorb forces imparted thereto.

19. The writing instrument as in claim 18, wherein said solid ink driving member is formed from an elastometer.

20. The writing instrument as in claim 19, wherein said solid ink driving member is cylindrical.

21. The writing instrument as in claim 18, wherein said solid ink driving member is ink-repellant.

22. A pressurized writing instrument comprising:

an ink tube at least partially filled with a writing medium, said ink tube having a first end and a second end and an inner surface tapering from said second end to said first end;

a writing tip at said first end of said ink tube; and a pressurization system comprising a compressible symmetrically shaped ink driving member having a diameter large enough to fit deformably into and to contact said tapered inner surface of said ink tube such that said ink driving member exerts a uniform compression load on said tapered inner surface of said ink tube as said ink driving member moves from said second end to said first end and need not be oriented in a particular longitudinal direction before insertion into said ink tube.

23. The writing instrument as in claim 22, wherein said symmetrically shaped ink driving member is formed from an elastomer.

24. The writing instrument as in claim 22, wherein said symmetrically shaped ink driving member is spherical.

25. The writing instrument as in claim 22, wherein said symmetrically shaped ink driving member is cylindrical.

26. The writing instrument as in claim 22, wherein said symmetrically shaped ink driving member is solid.

* * * * *